US006076636A

United States Patent [19]

Tietge

[11] Patent Number: 6,076,636

[45] Date of Patent: Jun. 20, 2000

[54] PAINT CAN HOLDER

[76] Inventor: Christopher J. Tietge, 1271 Crawford-Tom's Run Rd., New Lebanon, Ohio 45345

[21] Appl. No.: 09/368,695

[22] Filed: Aug. 5, 1999

[51] Int. Cl.[7] ..... E06C 7/14

[52] U.S. Cl. ..... 182/129; 248/210

[58] Field of Search ..... 182/129; 248/210, 248/211, 238

[56] References Cited

U.S. PATENT DOCUMENTS

| | | | |
|---|---|---|---|
| 2,466,840 | 4/1949 | Crawford | 182/129 |
| 2,990,152 | 6/1961 | Whitney | 248/210 |
| 4,824,060 | 4/1989 | Korda | 182/129 |
| 5,934,632 | 8/1999 | Weaver | 248/210 |

FOREIGN PATENT DOCUMENTS

| | | | |
|---|---|---|---|
| 2633201 | 12/1989 | France | 248/210 |

*Primary Examiner*—Alvin Chin-Shue

[57] ABSTRACT

A paint can holder for holding a can of paint to a ladder. The paint can holder includes an elongate mounting shaft for insertion through an open ended tubular rung of a ladder. Coupled to one end of the mounting shaft is a holding ring for extending a paint can therethrough. A pair of resting arms for resting the paint can thereon are coupled to the end of the mounting shaft and extend below the holding ring.

9 Claims, 3 Drawing Sheets

PAINT CAN HOLDER

BACKGROUND OF THE INVENTION

1. Field of the Invention

The present invention relates to paint can holders and more particularly pertains to a new paint can holder for holding a can of paint to a ladder.

2. Description of the Prior Art

The use of paint can holders is known in the prior art. More specifically, paint can holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,649,682; 5,293,957; 3,131,900; 3,559,939; 3,269,683; U.S. Pat. No. Des. 353,242; and U.S. Pat. No. Des. 313,742.

While these devices fulfill their respective, particular objectives and requirements, the aforementioned patents do not disclose a new paint can holder. The inventive device includes an elongate mounting shaft for insertion through an open ended tubular rung of a ladder. Coupled to one end of the mounting shaft is a holding ring for extending a paint can therethrough. A pair of resting arms for resting the paint can thereon are coupled to the end of the mounting shaft and extend below the holding ring.

In these respects, the paint can holder according to the present invention substantially departs from the conventional concepts and designs of the prior art, and in so doing provides an apparatus primarily developed for the purpose of holding a can of paint to a ladder.

SUMMARY OF THE INVENTION

In view of the foregoing disadvantages inherent in the known types of paint can holders now present in the prior art, the present invention provides a new paint can holder construction wherein the same can be utilized for holding a can of paint to a ladder.

The general purpose of the present invention, which will be described subsequently in greater detail, is to provide a new paint can holder apparatus and method which has many of the advantages of the paint can holders mentioned heretofore and many novel features that result in a new paint can holder which is not anticipated, rendered obvious, suggested, or even implied by any of the prior art paint can holders, either alone or in any combination thereof.

To attain this, the present invention generally comprises an elongate mounting shaft for insertion through an open ended tubular rung of a ladder. Coupled to one end of the mounting shaft is a holding ring for extending a paint can therethrough. A pair of resting arms for resting the paint can thereon are coupled to the end of the mounting shaft and extend below the holding ring.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new paint can holder apparatus and method which has many of the advantages of the paint can holders mentioned heretofore and many novel features that result in a new paint can holder which is not anticipated, rendered obvious, suggested, or even implied by any of the prior art paint can holders, either alone or in any combination thereof.

It is another object of the present invention to provide a new paint can holder which may be easily and efficiently manufactured and marketed.

It is a further object of the present invention to provide a new paint can holder which is of a durable and reliable construction.

An even further object of the present invention is to provide a new paint can holder which is susceptible of a low cost of manufacture with regard to both materials and labor, and which accordingly is then susceptible of low prices of sale to the consuming public, thereby making such paint can holder economically available to the buying public.

Still yet another object of the present invention is to provide a new paint can holder which provides in the apparatuses and methods of the prior art some of the advantages thereof, while simultaneously overcoming some of the disadvantages normally associated therewith.

Still another object of the present invention is to provide a new paint can holder for holding a can of paint to a ladder.

Yet another object of the present invention is to provide a new paint can holder which includes an elongate mounting shaft for insertion through an open ended tubular rung of a ladder. Coupled to one end of the mounting shaft is a holding ring for extending a paint can therethrough. A pair of resting arms for resting the paint can thereon are coupled to the end of the mounting shaft and extend below the holding ring.

Still yet another object of the present invention is to provide a new paint can holder that may also include a paint brush container attached thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
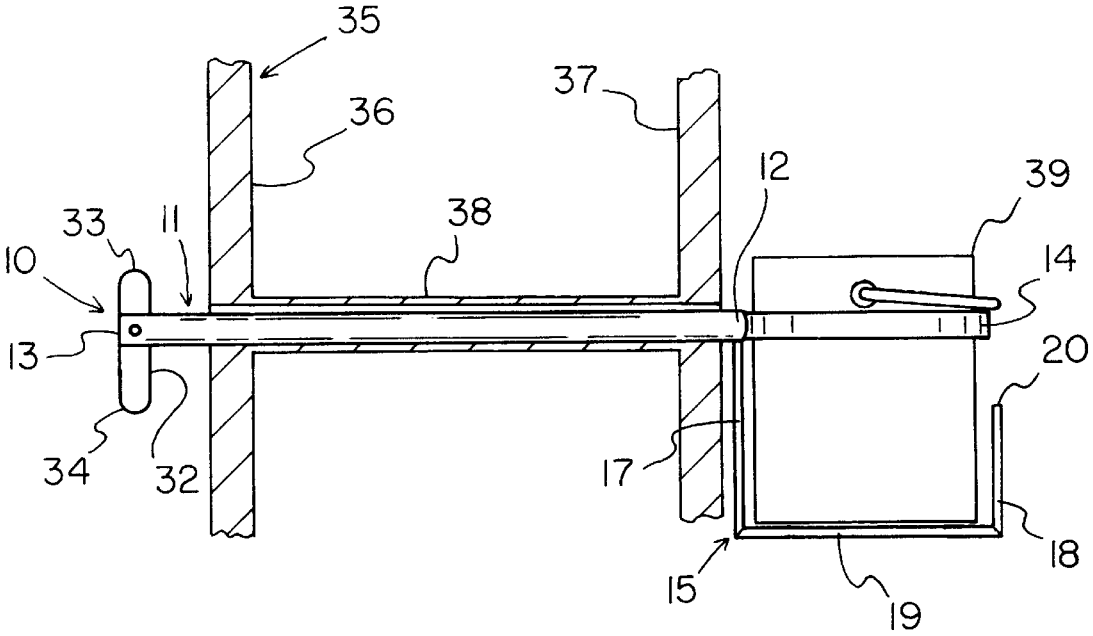
FIG. 1 is a schematic break-away side view of a new paint can holder in use according to the present invention.

With reference now to the drawings, and in particular to FIGS. 1 through 6 thereof, a new paint can holder embodying the principles and concepts of the present invention and generally designated by the reference numeral 10 will be described.

As best illustrated in FIGS. 1 through 6, the paint can holder 10 generally comprises an elongate mounting shaft for insertion through an open ended tubular rung of a ladder. Coupled to one end of the mounting shaft is a holding ring for extending a paint can therethrough. A pair of resting arms for resting the paint can thereon are coupled to the end of the mounting shaft and extend below the holding ring.

Figure 3:
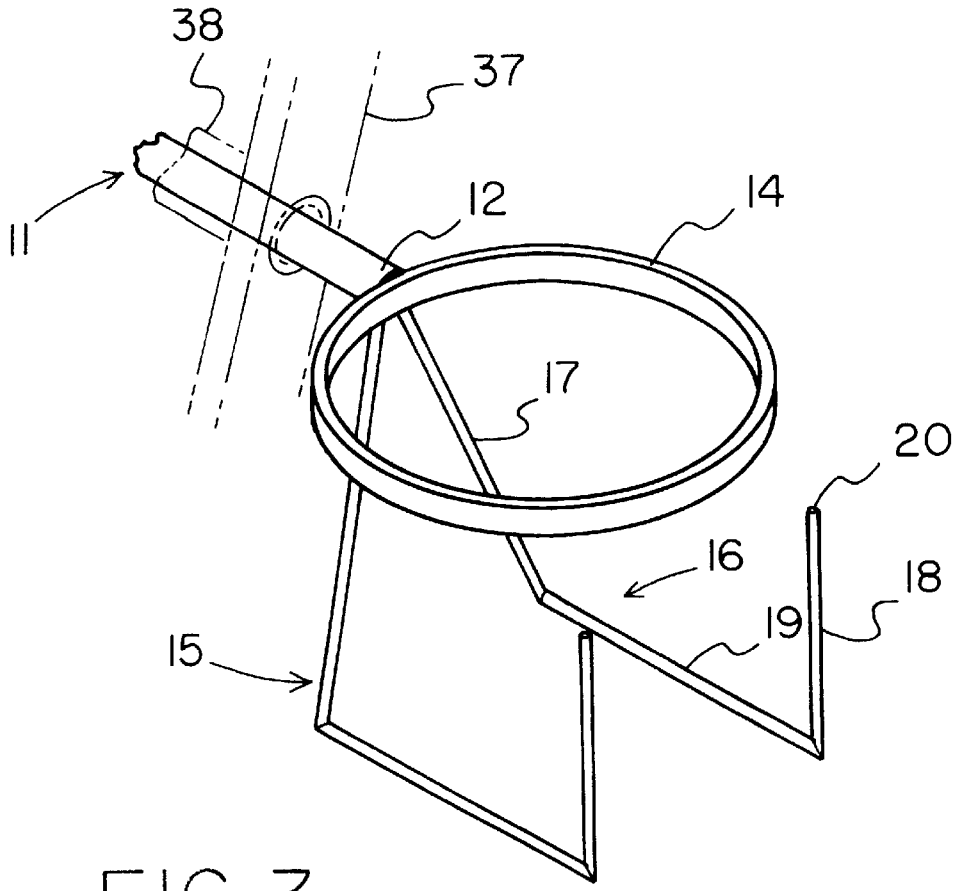
FIG. 3 is a schematic partial perspective view of the present invention in use.

In closer detail, the paint can holder 10 includes an elongate mounting shaft 11 having a pair of opposite ends 12,13, and a longitudinal axis extending between the ends of the mounting shaft. The mounting shaft may have a generally circular transverse cross section taken substantially perpendicular to the longitudinal axis of the mounting shaft. In one embodiment, the mounting shaft may even be tubular. In use, the mounting shaft is designed for extending through a tubular rung of a ladder to mount the pain can holder to the ladder as best illustrated in FIGS. 1 and 3.

A generally circular holding ring 14 is coupled to a first of the ends of the mounting shaft. In one embodiment, the holding ring may lie in a common plane with the longitudinal axis of the mounting shaft. In use, the holding ring is designed for extending a paint can therethrough such that the holding ring is disposed around the paint can with the handle of the paint can positioned above the holding ring as illustrated in FIG. 1.

A pair of resting arms 15,16 are coupled to the first end of the mounting shaft. The resting arms each have generally rectangular-U-shape and each comprises a spaced apart pair of elongate side portions 17,18 and an elongate bottom portion 19 connecting the elongate side portions of the respective resting arm together.

A first of the elongate side portions 17 of each resting arm is coupled to and downwardly extends from the first end of the mounting shaft. The first elongate side portions of the resting arms are extended in directions converging together at the first end of the mounting shaft. In one embodiment, the first elongate side portions of the resting arms may be extended at an acute angle to one another.

The elongate bottom portions of the resting arms are spaced beneath the holding ring as best illustrated in FIG. 1. The elongate bottom portions of the resting arms may be extended substantially parallel to one another and lie in a common plane with each other. In such an embodiment, the common plane of the elongate bottom portions is extended substantially parallel to the holding ring. In use, the bottom portions of the resting arms is designed for resting thereon the bottom of the paint can extended through the holding ring as shown in FIG. 1.

A second of the elongate side portions 18 of each resting arm is positioned below a distal portion of the holding ring diametrical opposite the first end of the mounting shaft. The second elongate side portions each have a free upper end 20 spaced below the distal portion of the holding ring. In one embodiment, the second elongate side portions may be extended substantially parallel to each other and substantially perpendicular to the elongate bottom portions of the resting arms.

In one embodiment, the paint can holder may also include a brush container 21 for holding at least one paint brush therein. The brush container has a bottom wall 22 and a perimeter side wall 23 upwardly extending around the bottom wall of the brush container, and an open top defined by an upper edge 24 of the perimeter side wall of the brush container. In use, the open top of the brush container is designed for inserting a paint brush into the brush container.

The perimeter side wall of the brush container may have spaced apart substantially planar proximal and distal panels 25,26. The proximal panel of the perimeter side wall may be extended substantially perpendicular to the bottom wall of the brush container. The distal panel of the perimeter side wall may be extended at an obtuse angle to the bottom wall of the brush container. In such an embodiment the proximal and distal panels of the perimeter side wall may lie in planes forming an acute angle therebetween.

The proximal panel of the perimeter side wall of the brush container has a spaced apart pair of tubular mounting sleeves 27,28 coupled to thereto on an exterior surface thereof. The mounting sleeves may be extended substantially parallel to each other. The mounting sleeves each have open upper and lower ends 29,30. The upper ends of the mounting sleeves are positioned towards the open top of the brush container and the lower ends of the mounting sleeves is positioned towards the bottom wall of the brush container. In one embodiment the upper ends of the mounting sleeves may lie in a common plane with the open top of the brush container. Also, the lower ends of the mounting sleeves may lie in a common plane with the bottom wall of the brush container.

Figure 5:
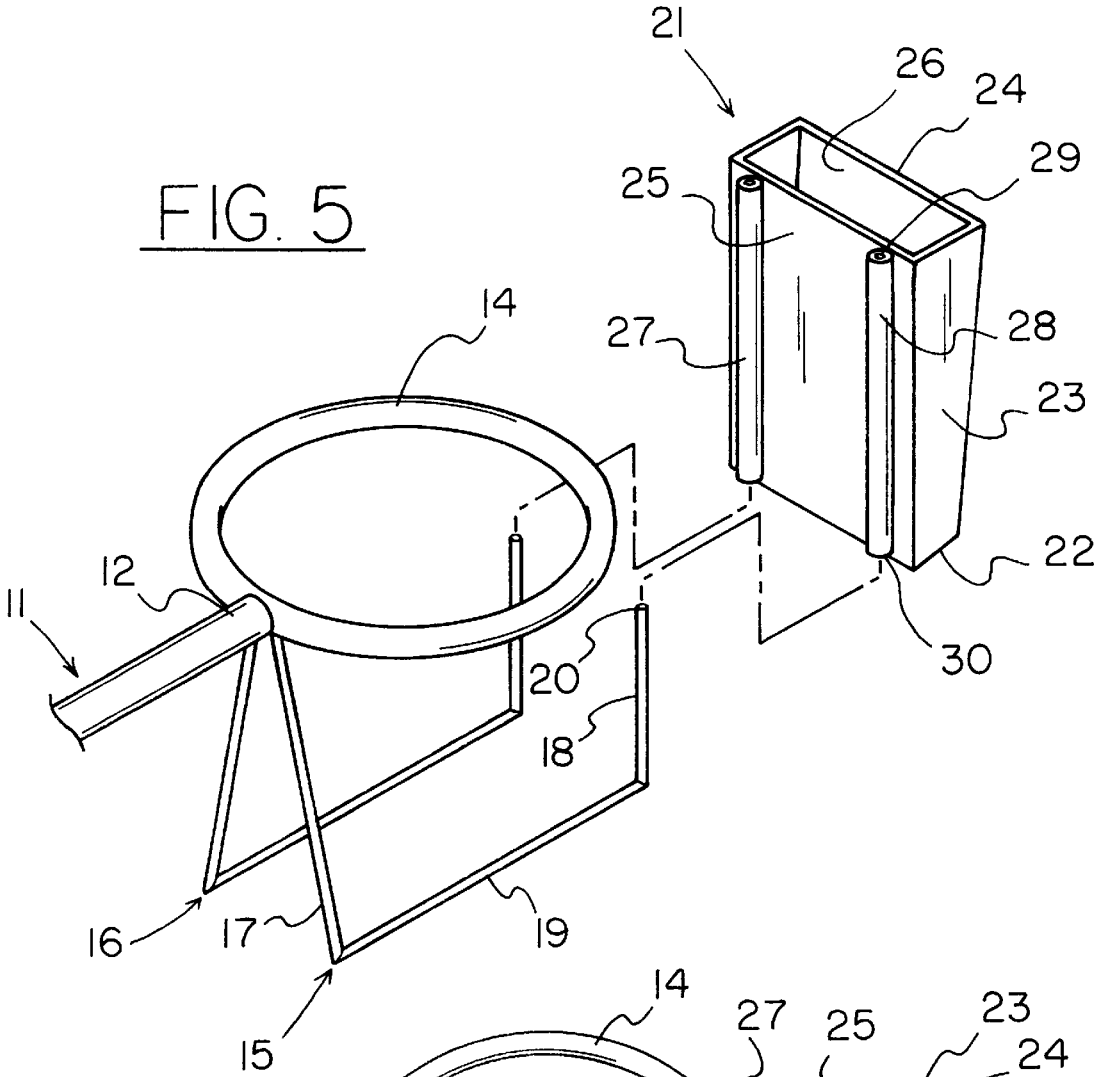
FIG. 5 is a schematic exploded partial perspective view of an embodiment of the present invention with a brush container.
Figure 6:
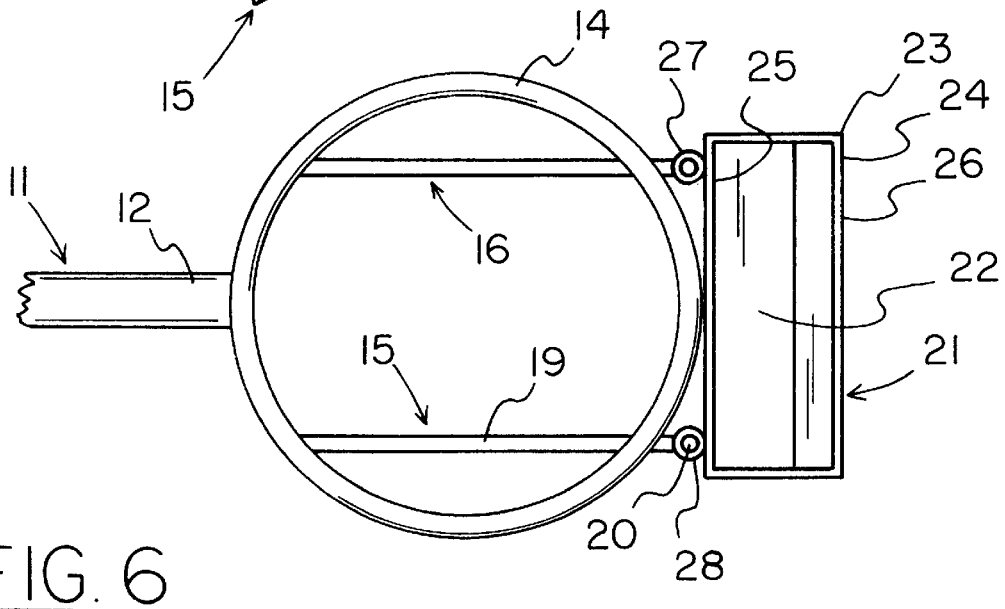
FIG. 6 is a schematic to view of an embodiment of the present invention with a brush container.

As illustrated in FIGS. 5 and 6, the free upper ends of the second elongate side portions of the resting arms are inserted into the lower ends of the mounting sleeves. Specifically, one second elongate side portion is inserted into one mounting sleeve and the other second elongate side portion is inserted into the other mounting sleeve.

Figure 2:
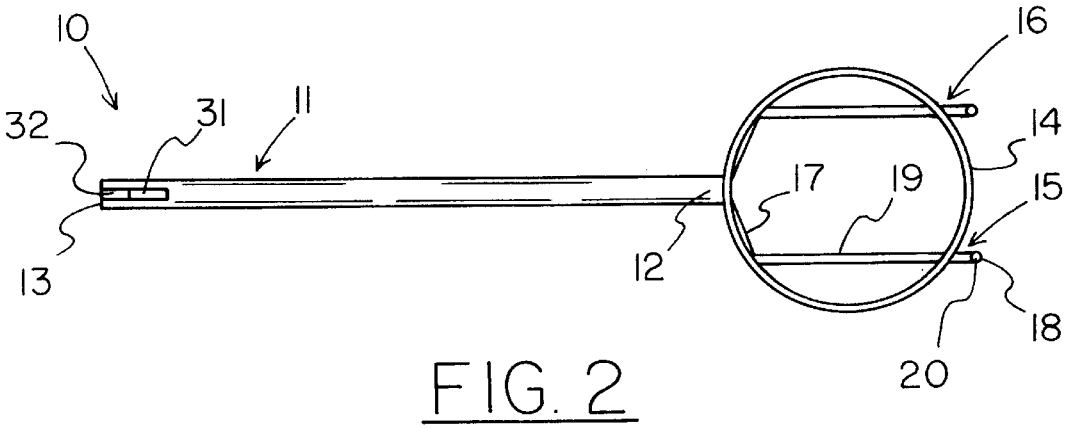
FIG. 2 is a schematic top view of the present invention.
Figure 4:
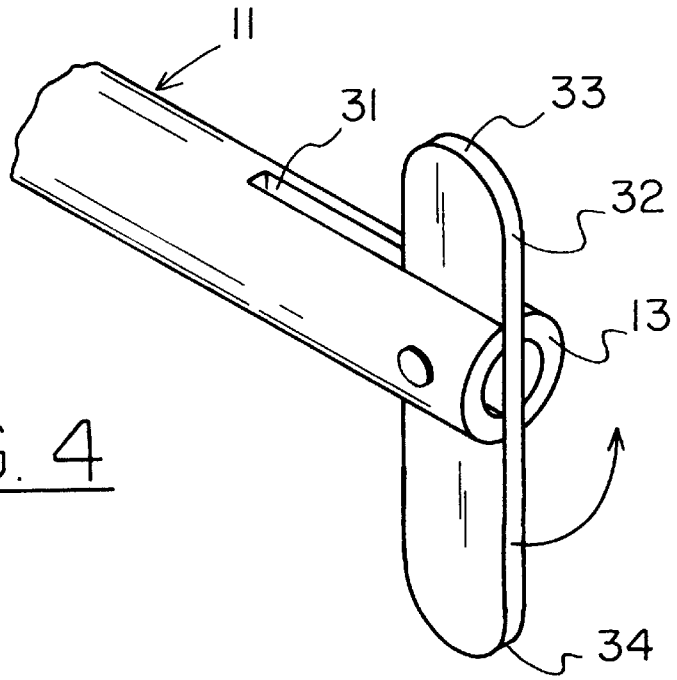
FIG. 4 is a schematic perspective view of the second end of the mounting shaft with the elongate stop in a deployed position.

With reference to FIGS. 1, 2, and 4, the mounting shaft may have a longitudinal slot 31 therethrough at a second of the ends of the mounting shaft. In this embodiment, a generally oblong and substantially planar elongate stop 32 is pivotally coupled to the second end of the mounting shaft in the longitudinal slot of the mounting shaft. As best illustrated in FIG. 4, the elongate stop has a pair of opposite free ends 33,34. The free ends of the elongate stop may be generally semi-circular in shape to prevent injury to a user when coming into contact with either free end of the elongate stop.

In use, the elongate stop is pivotable between deployed and retracted positions with respect to the mounting shaft. The elongate stop is extended substantially perpendicular to the longitudinal axis of the mounting shaft when positioned in the deployed position. The free ends of the elongate stop are outwardly extended in diametrically opposite directions away from the mounting shaft when the elongate stop is positioned in the deployed position. Conversely, the elongate stop is extended substantially parallel to the longitudinal axis of the mounting shaft when positioned in the retracted position. In this retracted position, one of the free ends of the elongate stop is disposed in the longitudinal slot of the mounting shaft and the other of the free ends of the elongate stop is outwardly extended from the second end of the mounting stop.

The paint can attachment is designed for use with a ladder 35 having a spaced apart pair of substantially parallel side rails 36,37 and at least one tubular rung 38 extending between the side rails of the ladder. The rung of the ladder has a substantially coaxial pair of opposite open ends. One of the open ends of the rung is located at one of the side rails and the other of the open ends of the rung is located at the other of the side rails.

In use, the elongate stop is first positioned in the retracted position. The second end of the mounting shaft may then extended through the open ends of the rung of the ladder such that the holding ring is outwardly extended from one of the side rails of the ladder and the resting arms extend downwards from the holding ring. The elongate stop may then pivoted to the deployed position to prevent removal of the mounting shaft from the rung without prior pivoting of the elongate stop to the retracted position as illustrated in FIG. 1.

A paint can 39 may be inserted through the holding ring so that the bottom of the paint can rests on the elongate bottom portions of the resting arms. If the brush container is attached to the paint can holder, a paint brush may also be held therein.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paint can holder for mounting to a ladder having an open ended tubular rung, said paint can holder comprising:

an elongate mounting shaft having a pair of opposite ends, and a longitudinal axis extending between said ends of said mounting shaft;

a holding ring for extending a paint can therethrough, said holding ring being coupled to a first of said ends of said mounting shaft; and a pair of resting arms for resting the paint can thereon, said resting arms being coupled to said first end of said mounting shaft and extending below said holding ring; and wherein said resting arms each have a spaced apart pair of elongate side portions and an elongate bottom portion connecting said elongate side portions of the respective resting arm together, a first of said elongate side portions of each resting arm being coupled to and downwardly extending from said first end of said mounting shaft, and said elongate bottom portions of said resting arms being spaced beneath said holding ring, wherein said first elongate side portions of said resting arms extend in directions converging together at said first end of said mounting shaft.

2. The paint can holder of claim 1, wherein said mounting shaft has a generally circular transverse cross section taken substantially perpendicular to said longitudinal axis of said mounting shaft.

3. The paint can holder of claim 1, wherein said holding ring lies in a common plane with said longitudinal axis of said mounting shaft.

4. The paint can holder of claim 1, further comprising a brush container attached to said resting arms, said brush container having a bottom wall and a perimeter side wall upwardly extending around said bottom wall of said brush container, and an open top.

5. The paint can holder of claim 4, wherein said perimeter side wall of said brush container has a spaced apart pair of tubular mounting sleeves coupled to thereto, wherein each resting arm has a free upper end, and wherein said free upper ends of said resting arms being inserted into said mounting sleeves to attach said brush container to said resting arms.

6. The paint can holder of claim 1, wherein said first elongate side portions of said resting arms are extended at an acute angle to one another.

7. The paint can holder of claim 1, wherein said elongate bottom portions of said resting arms are extended substantially parallel to one another and lie in a common plane with each other, said common plane of said elongate bottom portions being extended substantially parallel to said holding ring.

8.The paint can holder of claim 1, wherein said mounting shaft has a longitudinal slot therethrough at a second of said ends of said mounting shaft, an elongate stop being pivotally coupled to said second end of said mounting shaft in said longitudinal slot of said mounting shaft, said elongate stop having a pair of opposite free ends.

9. A paint can holder system, comprising:

a ladder having a spaced apart pair of substantially parallel side rails and at least one tubular rung extending between said side rails of said ladder;

said rung of said ladder having a substantially coaxial pair of opposite open ends, one of said open ends of said rung being located at one of said side rails and the other of said open ends of said rung being located at the other of said side rails;

a paint can holder, comprising:

an elongate mounting shaft having a pair of opposite ends, and a longitudinal axis extending between said ends of said mounting shaft;

said mounting shaft having a generally circular transverse cross section taken substantially perpendicular to said longitudinal axis of said mounting shaft;

a generally circular holding ring being coupled to a first of said ends of said mounting shaft;

said holding ring lying in a common plane with said longitudinal axis of said mounting shaft;

a pair of resting arms being coupled to said first end of said mounting shaft;

said resting arms each being a generally rectangular-U-shape and each having a spaced apart pair of elongate side portions and an said proximal panel of said perimeter side wall being extended substantially perpendicular to said bottom wall of said brush container, said distal panel of said perimeter side wall being extended at an obtuse angle to said bottom wall of said brush container;

said proximal and distal panels of said perimeter side wall lying in planes forming an acute angle therebetween;

said proximal panel of said perimeter side wall of said brush container having a spaced apart pair of tubular mounting sleeves coupled to thereto;

said mounting sleeves being extended substantially parallel to each other and extending;

said mounting sleeves each having open upper and lower ends;

said upper ends of said mounting sleeves being positioned towards said open top of said brush container, said lower ends of said mounting sleeves being positioned towards said bottom wall of said brush container;

said upper ends of said mounting sleeves lying in a common plane with said open top of said brush container, said lower ends of said mounting sleeves lying in a common plane with said bottom wall of said brush container;

said free upper ends of said second elongate side portions of said resting arms being inserted into said lower ends of said mounting sleeves, one second elongate side portion being inserted into one mounting sleeve and the other second elongate side portion being inserted into the other mounting sleeve;

said mounting shaft having a longitudinal slot therethrough at a second of said ends of said mounting shaft;

elongate bottom portion connecting said elongate side portions of the respective resting arm together;

a first of said elongate side portions of each resting arm being coupled to and downwardly extending from said first end of said mounting shaft;

said first elongate side portions of said resting arms extending in directions converging together at said first end of said mounting shaft;

said first elongate side portions of said resting arms being extended at an acute angle to one another;

said elongate bottom portions of said resting arms being spaced beneath said holding ring;

said elongate bottom portions of said resting arms being extended substantially parallel to one another and lying in a common plane with each other, said common plane of said elongate bottom portions being extended substantially parallel to said holding ring;

a second of said elongate side portions of each resting arm being positioned below a distal portion of said holding ring diametrical opposite said first end of said mounting shaft;

said second elongate side portions each having a free upper end spaced below said distal portion of said holding ring;

said second elongate side portions being extended substantially parallel to each other and substantially perpendicular to the elongate bottom portions of said resting arms;

a brush container having a bottom wall and a perimeter side wall upwardly extending around said bottom wall of said brush container, and an open top;

said perimeter side wall of said brush container having spaced apart substantially planar proximal and distal panels;

a generally oblong and substantially planar elongate stop being pivotally coupled to said second end of said mounting shaft in said longitudinal slot of said mounting shaft;

said elongate stop having a pair of opposite free ends;

said elongate stop being pivotable between deployed and retracted positions with respect to said mounting shaft;

said elongate stop being extended substantially perpendicular to said longitudinal axis of said mounting shaft when positioned in said deployed position;

said free ends of said elongate stop being outwardly extended in diametrically opposite directions away from said mounting shaft when said elongate stop is positioned in said deployed position;

said elongate stop being extended substantially parallel to said longitudinal axis of said mounting shaft when positioned in said retracted position;

one of said free ends of said elongate stop being disposed in said longitudinal slot of said mounting shaft and the other of said free ends of said elongate stop being outwardly extended from said second end of said mounting stop when said elongate stop is positioned in said deployed position;

said second end of said mounting shaft being extended through said open ends of said rung of said ladder such that said holding ring is outwardly extended from one of said side rails of said ladder; and said elongate stop being pivoted to said deployed position to prevent removal of said mounting shaft from said rung without prior pivoting of said elongate stop to said retracted position.

* * * * *